US011747762B2

(12) United States Patent
Inaba

(10) Patent No.: US 11,747,762 B2
(45) Date of Patent: Sep. 5, 2023

(54) GLOSSINESS DETECTOR, IMAGE FORMING APPARATUS, AND SHEET CONVEYANCE SYSTEM

(71) Applicant: KONICA MINOLTA, INC., Tokyo (JP)

(72) Inventor: Yasunori Inaba, Ino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/882,153

(22) Filed: Aug. 5, 2022

(65) Prior Publication Data

US 2023/0083046 A1 Mar. 16, 2023

(30) Foreign Application Priority Data

Sep. 16, 2021 (JP) ..... 2021-150810

(51) Int. Cl.
*G03G 15/20* (2006.01)
*G03G 15/00* (2006.01)
*G03G 15/01* (2006.01)

(52) U.S. Cl.
CPC ..... *G03G 15/6585* (2013.01); *G03G 15/0194* (2013.01); *G03G 2215/00805* (2013.01)

(58) Field of Classification Search
CPC ..... G03G 15/01; G03G 15/0194; G03G 15/5025; G03G 15/5041; G03G 15/5054; G03G 15/5062; G03G 15/6585; G03G 2215/00805
See application file for complete search history.

(56) References Cited

U.S. PATENT DOCUMENTS 11,567,439 B2 * 1/2023 Soeta ..... G03G 15/01
2014/0093262 A1 * 4/2014 Kamei ..... G03G 15/5058 399/49

FOREIGN PATENT DOCUMENTS

JP 2003140415 A 5/2003

* cited by examiner

*Primary Examiner* — Hoang X Ngo
(74) *Attorney, Agent, or Firm* — Holtz, Holtz & Volek PC

(57) ABSTRACT

A glossiness detector includes a glossiness sensor, a glossiness corrector, and a reference plate. The glossiness corrector corrects glossiness detected by the glossiness sensor. The reference plate is used for correction processing of the glossiness sensor. Then, the glossiness corrector acquires a glossy reflection profile of the reference plate that has been detected in advance. The glossiness corrector corrects the glossiness according to the reference plate on the basis of the glossy reflection profile and a gloss distribution of the reference plate that has been detected by the glossiness sensor.

14 Claims, 8 Drawing Sheets

GLOSSINESS DETECTOR, IMAGE FORMING APPARATUS, AND SHEET CONVEYANCE SYSTEM

CROSS-REFERENCE TO RELATED APPLICATIONS

The entire disclosure of Japanese patent Application No. 2021-150810, filed on Sep. 16, 2021 is incorporated herein by reference in its entirety.

BACKGROUND

Technological Field

The present invention relates to a glossiness detector, an image forming apparatus, and a sheet conveyance system.

Description of the Related Art

An image forming apparatus includes an image former that forms an image on a recording medium, and forms an image on the recording medium using the image former on the basis of output job information. In addition, the image forming apparatus is provided with a glossiness detector including a glossiness sensor that detects glossiness of the recording medium or an image formed on the recording medium.

The glossiness detector performs correction processing (calibration) of the glossiness sensor in order to correct an alignment error in a light source or a light receiver, a light quantity variation in the light source, an electrical variation in a drive circuit, and the like. Examples of the correction processing by the glossiness detector include those described in, for example, Patent Literature 1. In Patent Literature 1, a glass plate is used as a reference plate in order to calibrate a glossiness detector. The glass plate is irradiated with light, and a light receiver detects the quantity of the light reflected from the glass plate, whereby the correction processing is performed.

Related Art Literature

Patent Literature

Patent Literature 1: JP 2003-140415 A

SUMMARY

In the technology described in Patent Literature 1, however, a variation occurs in gloss distribution obtained by using the reference plate. In addition, when inexpensive glossy white paper, a white plate, or the like was used as the reference plate instead of the glass plate, the variation in gloss distribution for each reference plate was larger than that for the glass plate. As a result, there has been a problem that an error occurs in the corrected value of the glossiness sensor and the glossiness of a recording medium or an image formed on the recording medium cannot be accurately detected.

In view of the above conventional problem, an object of the present invention is to provide a glossiness detector, an image forming apparatus, and a sheet conveyance system that are capable of improving the correction accuracy of a glossiness sensor.

In order to solve the above problem and achieve the object of the present invention, the glossiness detector includes a glossiness sensor, a glossiness corrector, and a reference plate. The glossiness sensor includes a light source that emits light and a light receiver that receives the light emitted from the light source. The glossiness corrector corrects glossiness detected by the glossiness sensor. The reference plate is used for correction processing of the glossiness sensor.

Then, the glossiness corrector acquires a glossy reflection profile of the reference plate that has been detected in advance.

The glossiness corrector corrects the glossiness according to the reference plate on the basis of the glossy reflection profile and a gloss distribution of the reference plate that has been detected by the glossiness sensor.

An image forming apparatus of the present invention includes the above glossiness detector. A sheet conveyance system of the present invention includes the above glossiness detector in an image forming apparatus.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
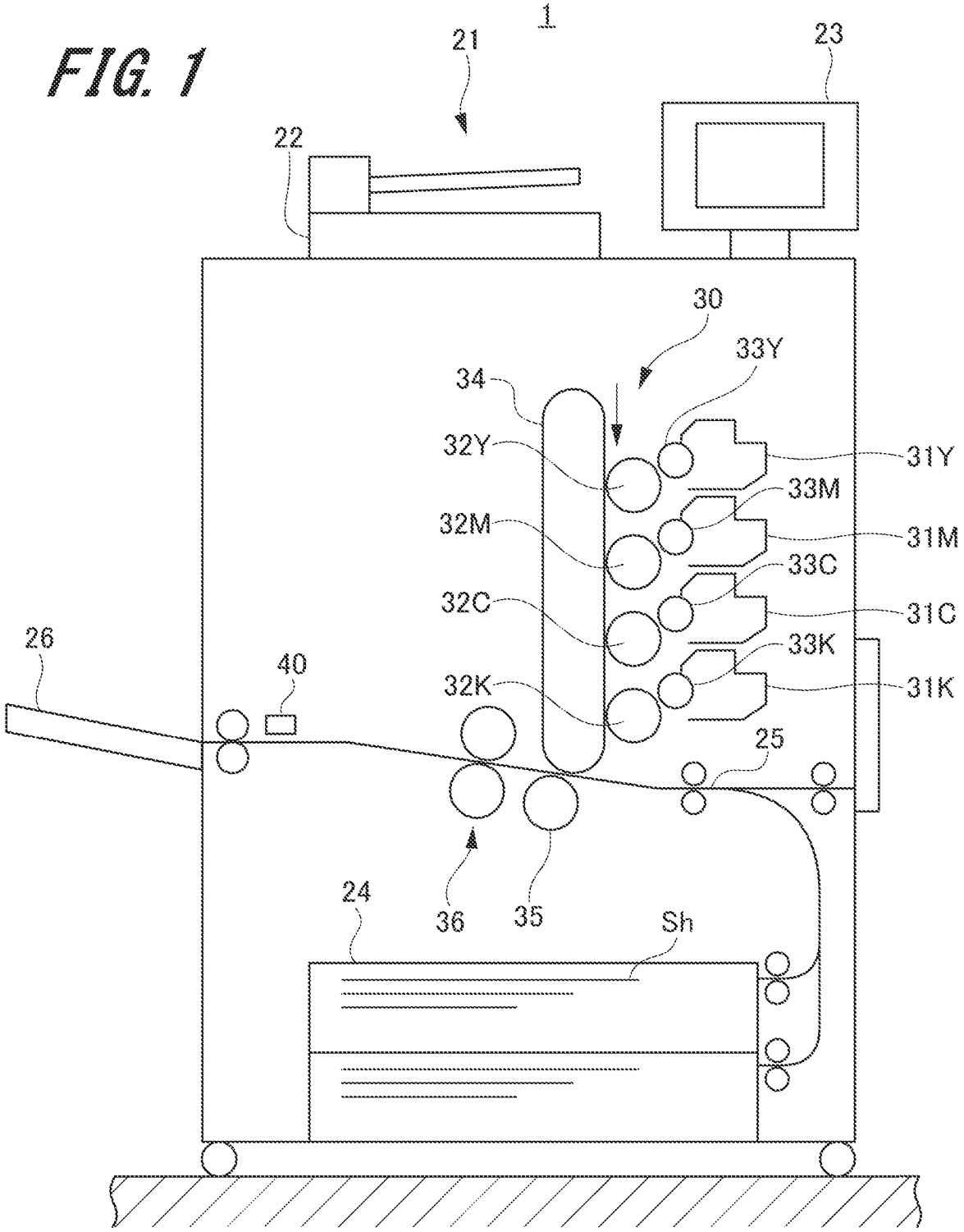
FIG. 1 is a schematic configuration diagram illustrating an overall configuration of an image forming apparatus according to an embodiment example of the present invention.

Hereinafter, one or more embodiments of the present invention will be described with reference to the drawings. However, the scope of the invention is not limited to the disclosed embodiments.

Hereinafter, embodiments for carrying out the present invention will be described with reference to FIGS. 1 to 8.

In the drawings, the same members are denoted by the same reference numerals. In addition, the present invention is not limited to the following embodiments.

1. Embodiment Example 1-1. Configuration of Image Forming Apparatus

First, an overall configuration of an image forming apparatus according to an embodiment example of the present invention (hereinafter, referred to as "present example") will be described. FIG. 1 is a schematic configuration diagram of an image forming apparatus 1 of the present example.

The image forming apparatus 1 illustrated in FIG. 1 forms an image on a sheet by an electrophotographic method, and is a tandem-type color image forming apparatus in which toners of four colors of yellow (Y), magenta (M), cyan (C), and black (Bk) are superimposed.

The image forming apparatus 1 includes a document reader 21 including an auto document feeder (ADF) 22, and an operation display 23.

The document reader 21 optically reads an image from a document on a document feed table of the ADF 22, performs A/D conversion on the read image, and generates image data (scan data).

The operation display 23 includes a touch panel in which a touch sensor as an operation input unit is superimposed on a display including a liquid crystal display (LCD), an organic electro luminescence (EL) display, or the like. Note that an example, in which the display and the operation input unit are integrally formed, is given in the present example, but the present invention is not limited thereto. An operation input unit including buttons, keys, or the like, and a display including an LCD or the like may be formed separately.

Figure 6:
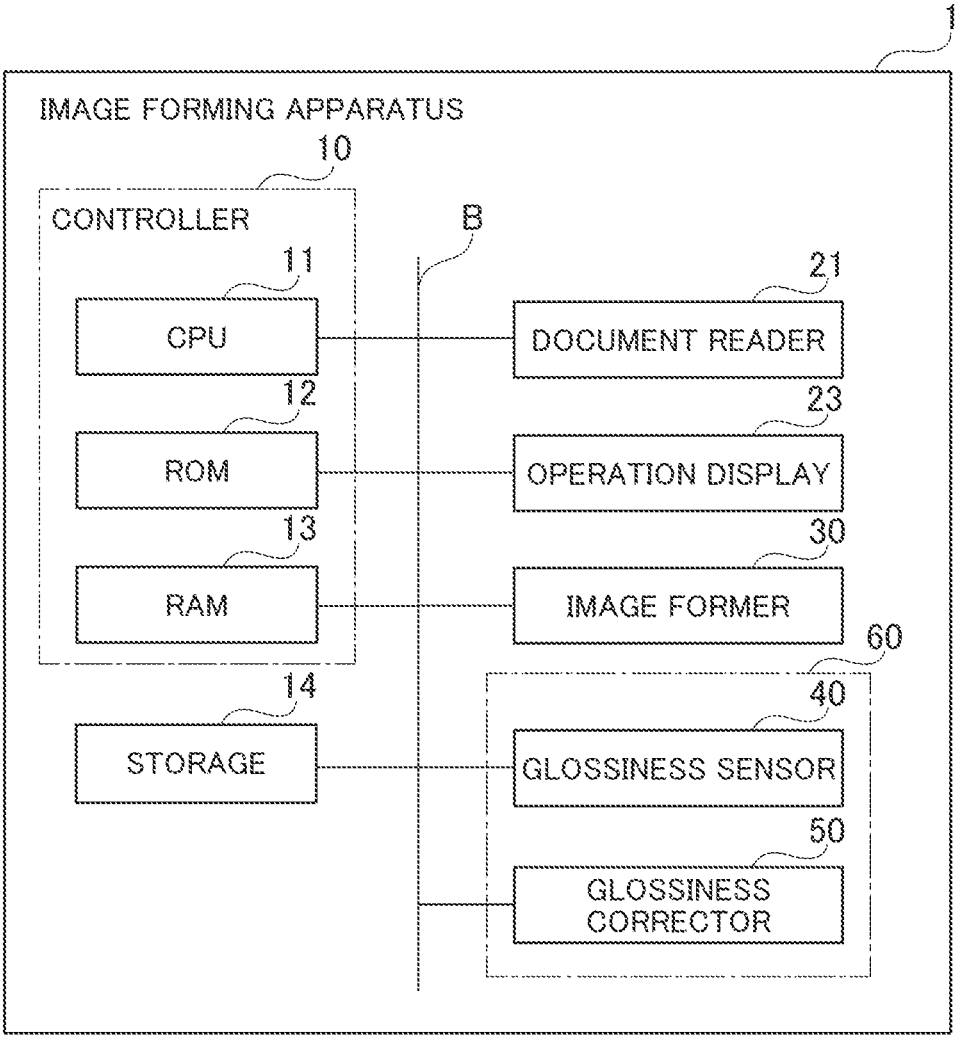
FIG. 6 is a block diagram illustrating a configuration of hardware of the image forming apparatus according to the embodiment example of the present invention.

The operation display 23 generates an operation signal indicating the content of an operation input to an operation unit from a user, and supplies the operation signal to a controller 10 (see FIG. 6). When the user inputs, for example, an operation for ordering the start of image forming processing, the operation display 23 generates a signal for starting the image forming processing and supplies the signal to the controller 10. In addition, on the basis of a display signal supplied from the controller 10, the operation display 23 displays, on its display, the content of an operation by a user, setting information, or the like.

The image forming apparatus 1 further includes a sheet feed tray 24, a conveyance path 25, a sheet discharge tray 26, an image former 30, and a glossiness sensor 40.

The sheet feed tray 24 is a container that houses a sheet Sh on which an image is formed by the image former 30. In the image forming apparatus 1 illustrated in FIG. 1, an example in which there are two sheet feed trays 24 is illustrated. The present invention is not limited thereto, and the number of the sheet feed trays 24 may be one or three or more.

The conveyance path 25 conveys the sheet Sh fed from the sheet feed tray 24 to the sheet discharge tray 26. The conveyance path 25 is provided with a plurality of rollers (conveyance rollers) for conveying the sheet Sh. Although a configuration, in which the conveyance path 25 does not have a path and mechanism for double-sided printing, is illustrated, the present invention is not limited thereto. The present invention may be applied to an image forming apparatus having a path and mechanism for double-sided printing.

The image former 30 includes four image forming units 31Y, 31M, 31C, and 31K for forming toner images of respective colors of Y, M, C, and K. The image forming units 31Y, 31M, 31C, and 31K respectively include charging units, LED writing units (laser light sources) (which are not illustrated), photoreceptor drums 32Y, 32M, 32C, and 32K, and developing units 33Y, 33M, 33C, and 33K.

The developing units 33Y, 33M, 33C, and 33K respectively form latent images on the surfaces (outer peripheral portions) of the photoreceptor drums 32Y, 32M, 32C, and 32K, and attach toner supplied from a non-illustrated developing device to the latent images. As a result, toner images are respectively formed on the photoreceptor drums 32Y, 32M, 32C, and 32K.

Note that when it is not necessary in the following description to individually distinguish the image forming units 31Y, 31M, 31C, and 31K, these are collectively referred to as an image forming unit 31. In addition, when it is not necessary to individually distinguish the photoreceptor drums 32Y, 32M, 32C, and 32K, these are collectively referred to as a photoreceptor drum 32. Furthermore, when it is not necessary to individually distinguish the developing units 33Y, 33M, 33C, and 33K, these are collectively referred to as a developing unit 33.

The image former 30 includes an intermediate transfer belt 34, a secondary transfer unit 35, and a fixing unit 36. The intermediate transfer belt 34 is formed in an endless shape and wound around a plurality of pulleys. The intermediate transfer belt 34 is rotated by a non-illustrated drive motor in a clockwise direction (a direction indicated by the arrow in the diagram) opposite to the direction in which the photoreceptor drum 32 is rotated.

The secondary transfer unit 35 is a roller that secondarily transfers the toner image of each color primarily transferred to the intermediate transfer belt 34 to the sheet Sh conveyed on the conveyance path 25.

The fixing unit 36 is provided downstream, in the conveyance direction of the conveyance path 25, of a position where the secondary transfer unit 35 is arranged. The fixing unit 36 performs fixing processing of fixing the toner image, transferred to the sheet Sh by the secondary transfer unit 35, onto the sheet Sh. The sheet Sh, on which the toner image has been fixed by the fixing unit 36, is conveyed on the conveyance path 25 and discharged into the sheet discharge tray 26.

The glossiness sensor 40 is arranged on the downstream side, in the conveyance direction, of the fixing unit 36. The glossiness sensor 40 detects the glossiness of the sheet Sh conveyed by the conveyance path 25 or an image formed on the sheet Sh. Note that an example, in which the glossiness sensor 40 is arranged on the downstream side of the fixing unit 36, has been described in the present example, but the present invention is not limited thereto. For example, when the glossiness of the sheet Sh before the fixing is detected, the glossiness sensor 40 may be installed on the upstream side, in the conveyance direction, of the fixing unit 36 or the secondary transfer unit 35.

1-2. Configuration of Glossiness Sensor

Next, an example of the configuration of the glossiness sensor 40 will be described with reference to FIGS. 2 to 5.

Figure 2:
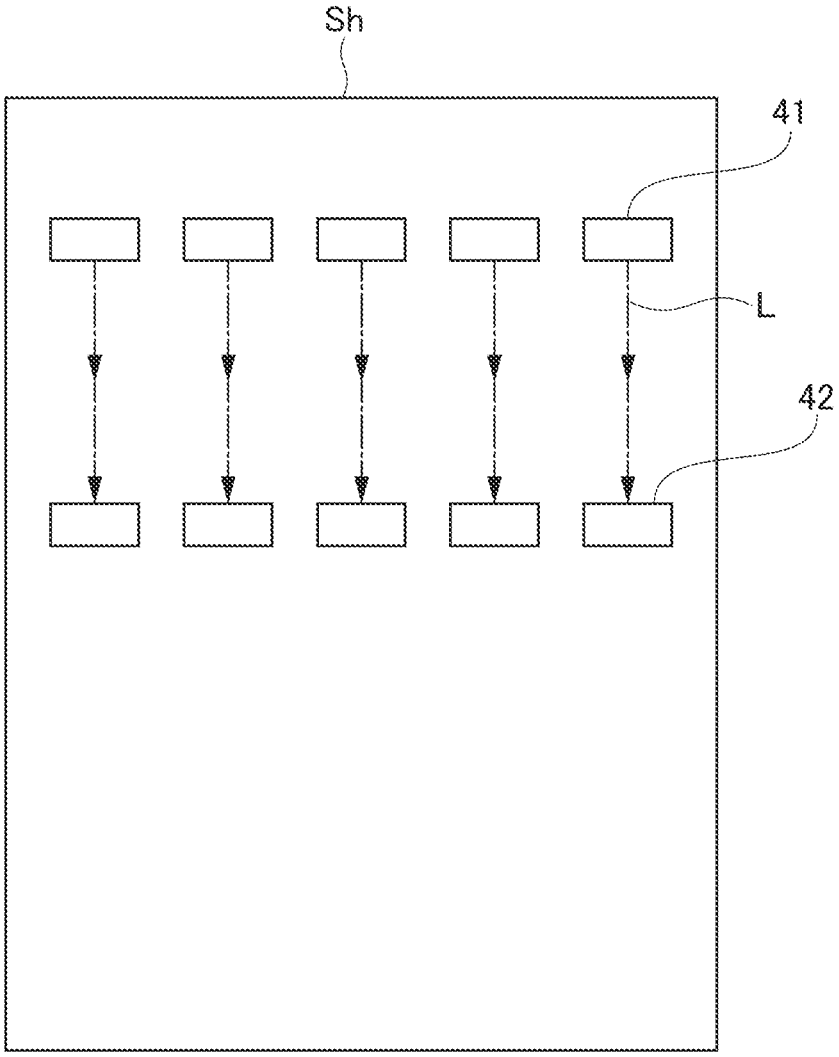
FIG. 2 is a plan view illustrating a glossiness sensor according to an embodiment example of the present invention.
Figure 3:
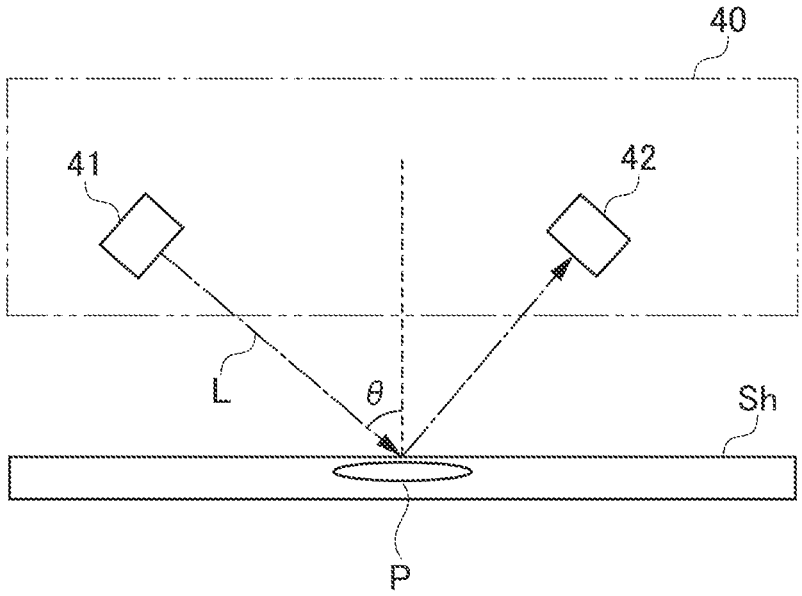
FIG. 3 is a schematic configuration diagram illustrating the glossiness sensor according to the embodiment example of the present invention.

FIG. 2 is a plan view of the glossiness sensor 40 as viewed from above. FIG. 3 is a schematic configuration diagram illustrating the glossiness sensor 40.

As illustrated in FIGS. 2 and 3, the glossiness sensor 40 includes a plurality of light sources 41 and a plurality of light receivers 42. The plurality of the light sources 41 are arranged side by side along a width direction orthogonal to the conveyance direction of the sheet Sh. The light source 41 includes, for example, a light emitting diode (LED), a laser oscillator, or the like. The light source 41 irradiates the sheet Sh conveyed or an image P formed on the sheet Sh with light L such as white light or ultraviolet rays. In the present example, the light source 41 is arranged such that an incident angle θ of the emitted light L relative to the surface of the sheet Sh becomes a predetermined angle. In order to detect specularly reflected light by the light receiver 42, the light emitted from the light source 41 preferably has some degree of directivity.

Similarly to the light sources 41, the plurality of the light receivers 42 are arranged side by side along the width direction orthogonal to the conveyance direction of the sheet Sh. The light receiver 42 includes a linear sensor in which light receiving elements, such as charge-coupled devices (CCDs) or complementary metal oxide semiconductors (CMOSs), are arranged one-dimensionally in a direction along the conveyance direction of the sheet Sh. The light receiver 42 acquires the specularly reflected light that has been emitted from the light source 41 and reflected by the surface of the sheet Sh. Although an example, in which the plurality of the light sources 41 and the plurality of the light receivers 42 are respectively arranged side by side along the width direction, has been described, the present invention is not limited thereto. The plurality of the light sources 41 and the plurality of the light receivers 42 may be respectively arranged along the conveyance direction.

In addition, the glossiness sensor 40 is provided with a white reference plate 43 (see FIGS. 4 and 5) serving as a reference plate for performing shading correction processing. The white reference plate 43 is made of, for example, white paper or a resin material such as PET. The white reference plate 43 reflects the light emitted from light source 41 toward light receiver 42. Note that an example, in which the white reference plate 43 is applied as the reference plate, has been described in the present example, but the present invention is not limited thereto. A colored plate may be applied as the reference plate.

Only one white reference plate 43 may be provided, or a plurality of the white reference plates may be provided for each of the plurality of the light sources 41 and the plurality of the light receivers 42.

Figure 4:
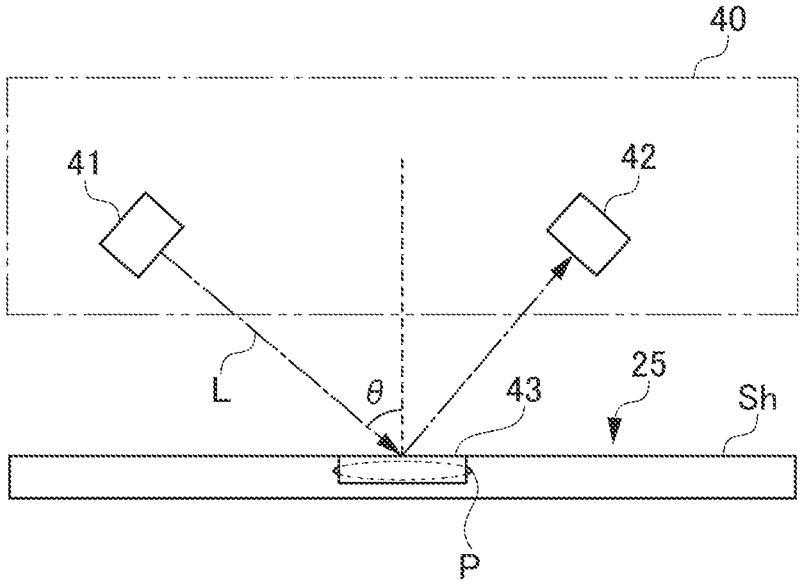
FIG. 4 is an explanatory diagram illustrating an example of the arrangement of a reference plate of the glossiness sensor according to the embodiment example of the present invention.
Figure 5:
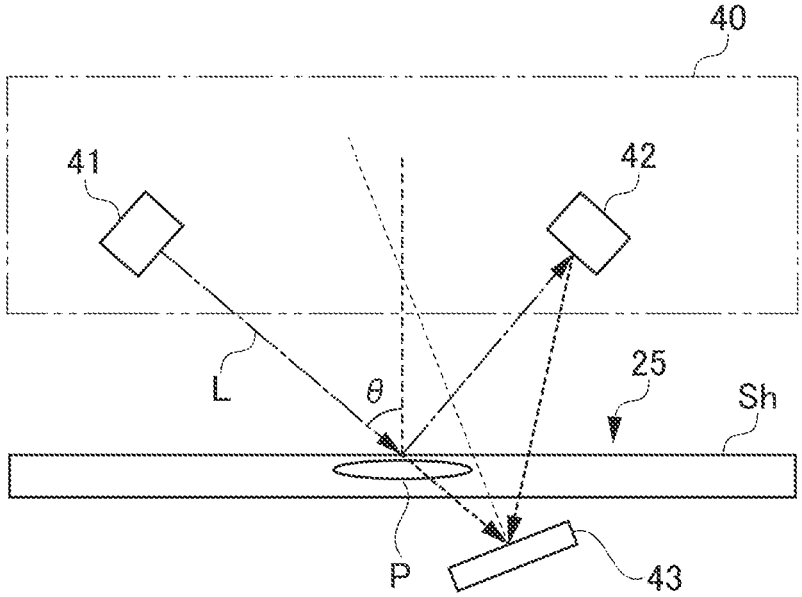
FIG. 5 is an explanatory diagram illustrating an example of the arrangement of a reference plate of the glossiness sensor according to the embodiment example of the present invention.

FIGS. 4 and 5 are explanatory diagrams each illustrating an example of the arrangement of the white reference plate 43.

In the example illustrated in FIG. 4, the white reference plate 43 is installed on the conveyance path 25 on which the sheet Sh is conveyed. In this case, the white reference plate 43 is supported by a non-illustrated movable mechanism so as to be movable from on the conveyance path 25. When an image is formed on the sheet Sh by the image forming apparatus 1, the white reference plate 43 is retracted to a position away from the conveyance path 25 by the movable mechanism. Then, when the shading correction processing of the glossiness sensor 40 is performed, the white reference plate 43 is moved onto the conveyance path 25 by the movable mechanism.

In the example illustrated in FIG. 5, the white reference plate 43 is arranged below the conveyance path 25. Therefore, the white reference plate 43 is arranged at a position retracted in advance from the conveyance path 25, so that a movable mechanism for moving the white reference plate 43 becomes unnecessary. The white reference plate 43 is arranged at a position similar to a position where the glossiness of the white reference plate 43 is detected using a master sensor described later and a glossy reflection profile is acquired.

1-3. Configuration of Hardware of Image Forming Apparatus

Next, a configuration of hardware of the image forming apparatus will be described with reference to FIG. 6.

FIG. 6 is a block diagram illustrating a configuration of hardware of the image forming apparatus 1.

The image forming apparatus 1 includes the controller 10, a storage 14, the document reader 21, the operation display 23, the image former 30, the glossiness sensor 40, and a glossiness corrector 50.

The controller 10 includes, for example, a central processing unit (CPU) 11, a read only memory (ROM) 12 for storing programs and the like executed by the CPU 11, and a random access memory (RAM) 13 to be used as a work area for the CPU 11.

The CPU 11 is connected to respective units constituting the image forming apparatus 1 via a system bus B.

The CPU 11 controls operations of the respective units by communicating with these respective units connected via the system bus B.

The CPU 11 controls the image former 30 such that a toner image for image formation is formed on the photoreceptor drum 32 (see FIG. 1) and the toner mage is primarily transferred to the intermediate transfer belt 34 (see FIG. 1). The CPU 11 also controls the glossiness sensor 40 such that the glossiness of the sheet Sh or of the image on the sheet Sh is detected.

The RAM 13 temporarily stores data and the like necessary for the CPU 11 to execute programs. The ROM 12 includes a nonvolatile memory, such as a semiconductor memory, and the like, and stores a system program corresponding to the image forming apparatus 1, various programs that can be executed on the system program, and the like. The programs stored in the ROM 12 are stored in the form of a computer-readable program code, and the CPU 11 sequentially executes operations according to the program code.

The storage 14 includes, for example, a hard disk drive (HDD) or a solid state drive (SSD), and stores a correction table to be used by the glossiness corrector 50 for correcting a reflectance, a glossy reflection profile M (see FIG. 8) of the white reference plate 43 that has been acquired in advance, and the like. Note that a correction coefficient and the glossy reflection profile M may be stored in the ROM 12 or the glossiness corrector 50 instead of the storage 14. In addition, the glossy reflection profile M may be acquired from an external server when the shading correction processing of the glossiness sensor 40 is performed, instead of being stored in the storage 14.

The glossiness sensor 40 outputs the glossiness of the sheet Sh or of the image formed on the sheet Sh that has been detected to the controller 10 or the glossiness corrector 50 via the system bus B. The glossiness corrector 50 calculates the correction coefficient on the basis of the glossy reflection profile M of the white reference plate 43. The glossiness corrector 50 further corrects (calibrates) an alignment error and glossiness in the glossiness sensor 40 on the basis of the calculated correction coefficient. The glossiness sensor 40 and the glossiness corrector 50 constitute a glossiness detector 60.

An example, in which the glossiness detector 60 is installed in the image forming apparatus 1, has been described in the present example, but the present invention is not limited thereto. The glossiness detector 60 may be installed in a sheet conveyance system that feeds a sheet to the image forming apparatus 1 and conveys the sheet discharged from the image forming apparatus 1.

2. Example of Correction Processing Operation of Glossiness Sensor

Next, an example of a correction processing operation of the glossiness sensor 40 in the image forming apparatus 1 having the above configuration will be described with reference to FIGS. 7 and 8.

Figure 7:
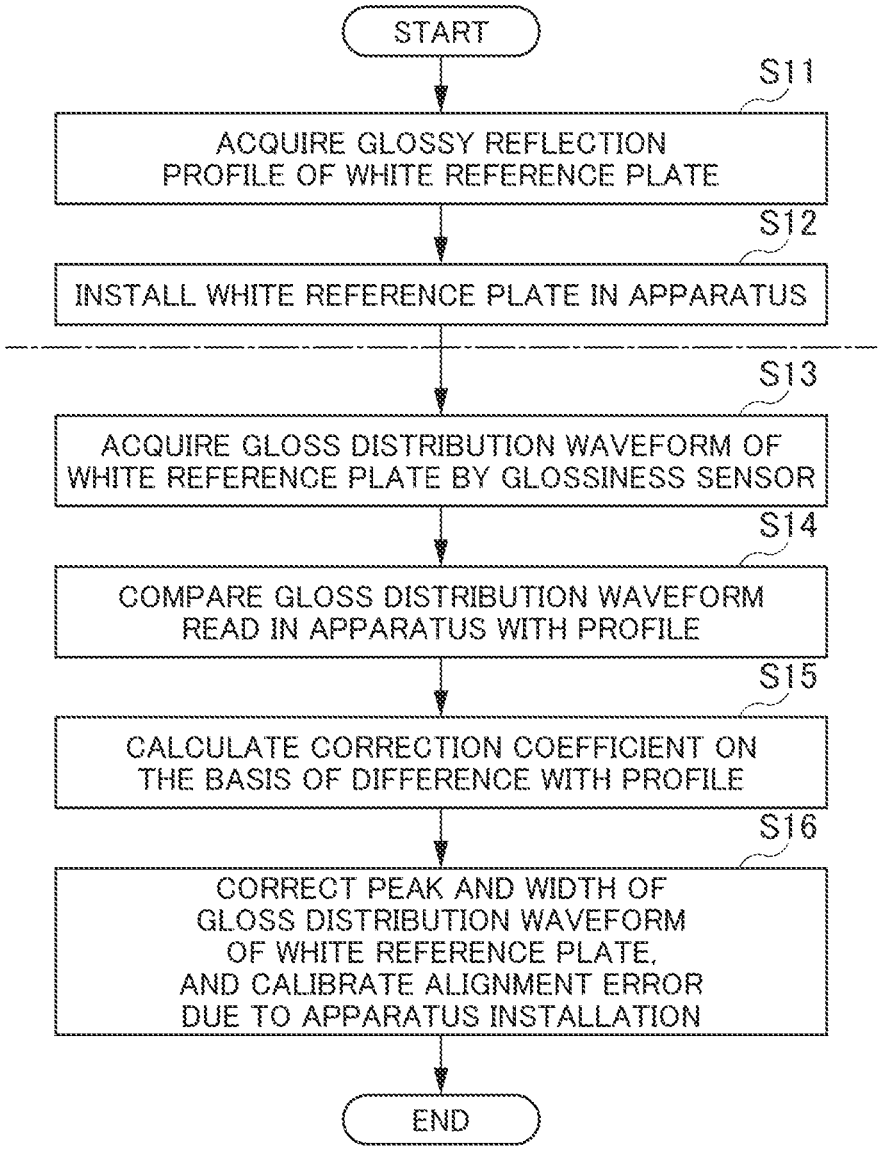
FIG. 7 is a flowchart illustrating an example of a correction processing operation of the glossiness sensor according to the embodiment example of the present invention.
Figure 8:
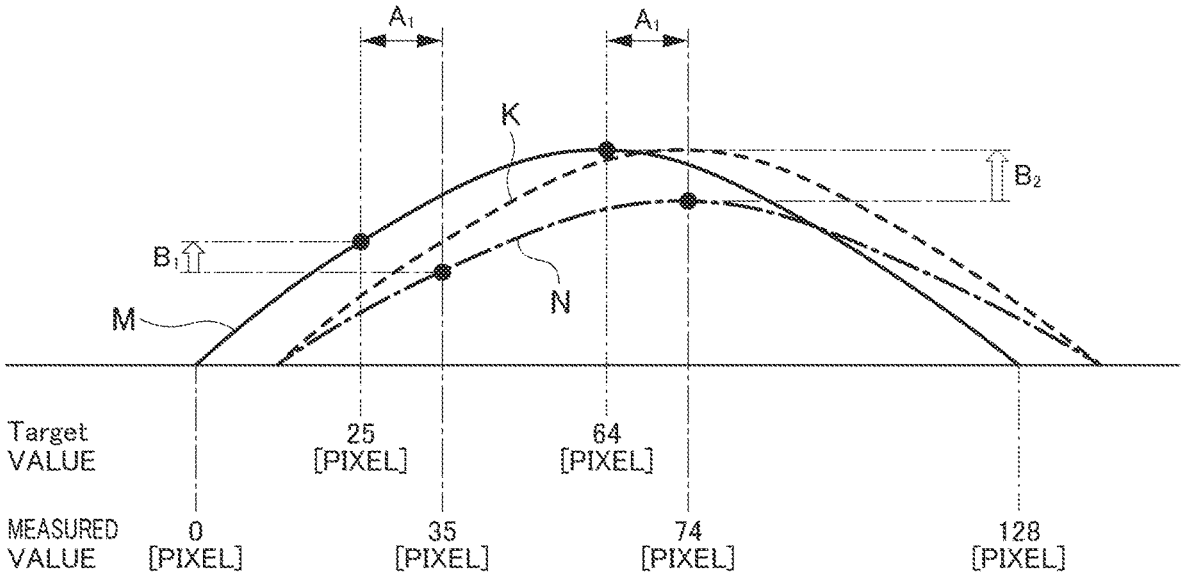
FIG. 8 is an explanatory diagram illustrating an example of the correction processing operation of the glossiness sensor according to the embodiment example of the present invention.

FIG. 7 is a flowchart illustrating an example of the correction processing operation. FIG. 8 is an explanatory diagram illustrating the example of the correction processing operation. In FIG. 8, the vertical axis represents a light quantity, and the horizontal axis represents the number of pixels.

First, the glossy reflection profile M of the white reference plate 43 installed in the image forming apparatus 1 is acquired (step S11). The glossy reflection profile M is acquired by irradiating the white reference plate 43 with light and measuring, using a master sensor that is of the same type as or has the equivalent performance to the glossiness sensor 40, a gloss distribution waveform (target waveform) obtained by receiving the reflected light. The glossy reflection profile M acquired in the processing of the step S11 is stored in the storage 14 or the glossiness corrector 50. Alternatively, the glossiness corrector 50 may acquire the profile M from a server provided outside the image forming apparatus 1, when the processing of a step S13 to be described later is performed.

The glossy reflection profile M is stored in the server by, for example, assigning an identification number to the white reference plate 43 and linking the identification number thereof to the glossy reflection profile M of the corresponding white reference plate 43. Then, when a user inputs the identification number of the white reference plate 43 to the image forming apparatus 1 or the glossiness corrector 50 reads the identification number of the white reference plate 43, the glossiness corrector 50 acquires the glossy reflection profile M corresponding to the installed white reference plate 43 from the server.

Next, the white reference plate 43 whose glossy reflection profile M has been acquired is installed in the image forming apparatus 1 (step S12). Note that the processing of the step S11 and the step S12 are performed, for example, when the image forming apparatus 1 is assembled, when a shipping inspection is performed on the image forming apparatus 1, when the white reference plate 43 is replaced, or the like.

After the white reference plate 43 is installed in the image forming apparatus 1, a gloss distribution waveform N of the white reference plate 43 is acquired using the glossiness sensor 40 provided in the image forming apparatus 1 (step S13). Next, the glossiness corrector 50 compares the gloss distribution waveform N read by the glossiness sensor 40 provided in the image forming apparatus 1 with the glossy reflection profile M (step S14).

Next, the glossiness corrector 50 calculates the correction coefficient on the basis of a difference $A_1$ between the glossy reflection profile M and the gloss distribution waveform N (step S15). Then, the glossiness corrector 50 stores the calculated correction coefficient in the storage 14 or the like.

In the calculation processing of the correction coefficient in the step S15, the glossiness corrector 50 detects, for example, peak positions of the glossy reflection profile M and the gloss distribution waveform N. In the example illustrated in FIG. 8, the peak position of the glossy reflection profile M is the position of the 64th pixel, and the peak position of the gloss distribution waveform N is the position of the 74th pixel. Then, the glossiness corrector 50 calculates a shift amount between the respective peak positions as the difference $A_1$. In the example illustrated in FIG. 8, the difference $A_1$ corresponds to 10 pixels.

Next, the glossiness corrector 50 calculates a gain value of light quantity with the glossy reflection profile M to be referred to for each pixel of the gloss distribution waveform N, that is, a correction coefficient B. In the example illustrated in FIG. 8, the pixel of the glossy reflection profile M to be compared with the 74th pixel of the gloss distribution waveform N is located at the position of the 64th pixel. Then, a gain value $B_2$ of the 64th pixel of the glossy reflection profile M relative to the 74th pixel of the gloss distribution waveform N is calculated. In addition, the pixel of the glossy reflection profile M to be compared at the position of the 35th pixel of the gloss distribution waveform N is set to be located at the position of the 25th pixel, because the pixel position is shifted by 10 pixels. Then, a gain value $B_1$ of the 25th pixel of the glossy reflection profile M relative to the 35th pixel of the gloss distribution waveform N is calculated. The glossiness corrector 50 performs the above processing for every pixel of the gloss distribution waveform N, and calculates the correction coefficient of each pixel. As a result, a distortion of the gloss distribution waveform N can be corrected.

Next, by multiplying the gloss distribution waveform N with the correction coefficient calculated in the processing of the step S15, the peak and width of the gloss distribution waveform N of the white reference plate 43 are corrected. That is, the glossiness corrector 50 obtains a corrected waveform K illustrated by the dotted line in FIG. 8 by multiplying the gloss distribution waveform N with the correction coefficient. Furthermore, an alignment error in the white reference plate 43 or the glossiness sensor 40 is calibrated on the basis of the difference $A_1$ between the glossy reflection profile M and the gloss distribution waveform N (step S16).

In the present example, the glossy reflection profile M of the white reference plate 43 installed in the apparatus is acquired in advance using the master sensor, as described above. Then, the glossy reflection profile M is compared with the gloss distribution waveform N of the white reference plate 43 when actually installed in the apparatus, thereby calculating the correction coefficient. As a result, the corrected waveform K illustrated in FIG. 8 can be brought close to the glossy reflection profile M. As a result, the data obtained by reading the white reference plate 43 by the master sensor can be made consistent with the data obtained by reading the white reference plate 43 installed in the image forming apparatus 1. Therefore, even if a variation occurs in the white reference plate 43, the correction accuracy of the glossiness sensor 40 can be improved.

As described above, the correction coefficient corresponding to the white reference plate 43 can be obtained. The glossiness corrector 50 also corrects the glossiness of the sheet Sh or of the image formed on the sheet Sh that has been detected by the glossiness sensor 40, by using the calculated correction coefficient. As a result, the detection accuracy of glossiness in the glossiness detector 60 can be improved.

Furthermore, the processing from the step S13 to the step S16 may be performed periodically. As a result, it is possible to correct a variation in the gloss distribution waveform caused by a deflection of the white reference plate 43, dirt, or the like. Furthermore, if the difference between the gloss distribution waveform N and the glossy reflection profile M or the correction coefficient exceeds a threshold, it is possible to notify a user that the replacement or cleaning of the white reference plate 43 or the maintenance of the glossiness sensor 40 needs to be performed.

The embodiment examples have been described above, including their actions and effects. However, the present invention is not limited to the above embodiment examples, and various modifications can be made without departing from the gist of the invention described in the claims.

In the above embodiment examples, a configuration is adopted in which a color image is formed using four sets of the image forming units. However, the image forming apparatus according to the present invention may be configured to form a monochrome image using one image forming unit.

Furthermore, an example, in which an image forming apparatus of an electrophotographic type is applied, has been described as the image forming apparatus, but the present invention is not limited thereto. For example, an inkjet printer that ejects ink toward a recording medium or other various image forming apparatuses may be applied.

In addition, some or all of the above components, functions, processing units, and the like may be realized by hardware, for example, by designing an integrated circuit or the like. In addition, the above components, functions, and the like may be realized by software by a processor interpreting and executing a program for realizing each function. Information, such as a program, a table, and a file for realizing each function, can be stored in a recording device such as a memory, a hard disk, or a solid state drive (SSD), or in a recording medium such as an IC card, an SD card, or a DVD.

Although an example, in which a sheet is applied as the recording medium, has been described, the present invention is not limited thereto. Various other media, such as a film and a fabric, can be applied as the recording medium.

Note that words, such as "parallel" and "orthogonal", are used in the present specification, but these words do not strictly mean only "parallel" and "orthogonal". The words may mean states of being "substantially parallel" and "substantially orthogonal" that respectively include "parallel" and "orthogonal" and are in a range in which the function can be exhibited.

Although embodiments of the present invention have been described and illustrated in detail, the disclosed embodiments are made for purposes of illustration and example only and not limitation. The scope of the present invention should be interpreted by terms of the appended claims.

DESCRIPTION OF REFERENCE NUMERALS

1 . . . image forming apparatus
10 . . . controller
11 . . . CPU
12 . . . ROM
13 . . . RAM
14 . . . storage
21 . . . document reader
22 . . . auto document feeder
23 . . . operation display
24 . . . sheet feed tray
25 . . . conveyance path
26 . . . sheet discharge tray
30 . . . image former
31 . . . image forming unit
32 . . . photoreceptor drum
33 . . . developing unit
34 . . . intermediate transfer belt
35 . . . secondary transfer unit
36 . . . fixing unit
40 . . . glossiness sensor
41 . . . light source
42 . . . light receiver
43 . . . white reference plate (reference plate)
50 . . . glossiness corrector
60 . . . glossiness detector

The invention claimed is:

1. A glossiness detector comprising:

a glossiness sensor that includes a light source that emits light and a light receiver that receives the light emitted from the light source;

a glossiness corrector that corrects glossiness detected by the glossiness sensor; and a reference plate that is used for correction processing of the glossiness sensor, wherein the glossiness corrector acquires a glossy reflection profile of the reference plate that has been detected in advance, and corrects the glossiness according to the reference plate on the basis of the glossy reflection profile and a gloss distribution of the reference plate that has been detected by the glossiness sensor.

2. The glossiness detector according to claim 1, wherein the glossiness corrector calculates a correction coefficient for correcting the gloss distribution of the reference plate on the basis of the glossy reflection profile and the gloss distribution of the reference plate that has been detected by the glossiness sensor.

3. The glossiness detector according to claim 2, wherein the glossiness corrector corrects a shape of the gloss distribution in the reference plate on the basis of the correction coefficient.

4. The glossiness detector according to claim 2, wherein the glossiness corrector calculates a shift amount of the glossiness sensor from a peak position of the glossy reflection profile and a peak position of the gloss distribution, and calculates the correction coefficient on the basis of the shift amount.

5. The glossiness detector according to claim 4, wherein the light receiver of the glossiness sensor is a linear sensor including a plurality of light receiving elements, and the glossiness corrector calculates the correction coefficient for each pixel in the glossiness sensor on the basis of the shift amount.

6. The glossiness detector according to claim 2, wherein the glossiness corrector determines abnormality in the glossiness sensor or the reference plate on the basis of the calculated correction coefficient.

7. The glossiness detector according to claim 1, comprising a storage that stores the glossy reflection profile.

8. The glossiness detector according to claim 7, wherein the glossiness sensor includes a plurality of the light receivers, and includes a plurality of the glossy reflection profiles corresponding to the respective light receivers, and the storage associates and stores the plurality of the glossy reflection profiles.

9. The glossiness detector according to claim 1, wherein an identification number is assigned to the reference plate, the glossy reflection profile is linked with the identification number, and the glossiness corrector acquires the glossy reflection profile on the basis of the identification number.

10. The glossiness detector according to claim 1, wherein the reference plate is formed of white paper, colored paper, or a resin material.

11. The glossiness detector according to claim 1, wherein the glossy reflection profile is measured using a master sensor of the same type as the glossiness sensor.

12. The glossiness detector according to claim 1, wherein the reference plate is a reference plate for performing shading correction.

13. An image forming apparatus comprising the glossiness detector according to claim 1.

14. A sheet conveyance system comprising the glossiness detector according to claim 1.

* * * * *